US006653987B1

(12) United States Patent
Lamensdorf et al.

(10) Patent No.: US 6,653,987 B1
(45) Date of Patent: Nov. 25, 2003

(54) DUAL-BAND QUADRIFILAR HELIX ANTENNA

(75) Inventors: David Lamensdorf, Concord, MA (US); Michael Smolinski, Lowell, MA (US); Eddie Rosario, Methuen, MA (US)

(73) Assignee: The Mitre Corporation, Bedford, MA (US)

( * ) Notice: Subject to any disclaimer, the term of this patent is extended or adjusted under 35 U.S.C. 154(b) by 0 days.

(21) Appl. No.: 10/174,330

(22) Filed: Jun. 18, 2002

(51) Int. Cl.[7] ..... H01Q 1/36
(52) U.S. Cl. ..... 343/895; 343/853
(58) Field of Search ..... 343/895, 850, 343/853, 702, 796

(56) References Cited

U.S. PATENT DOCUMENTS 5,909,196 A * 6/1999 O'Neill Jr. ..... 343/895
5,986,620 A * 11/1999 Filipovic ..... 343/895
5,990,847 A * 11/1999 Filipovic et al. ..... 343/895
6,133,891 A * 10/2000 Josypenko ..... 343/895
6,421,028 B1 * 7/2002 Ohgren et al. ..... 343/895

* cited by examiner

*Primary Examiner*—Hoang V. Nguyen
(74) *Attorney, Agent, or Firm*—Choate, Hall & Stewart

(57) ABSTRACT

Dual-band quadrifilar helix antennas, comprising four radiating elements arranged helically to define a cylinder of constant radius, each radiating element having an upper portion and a lower portion and a gap there between, each upper portion having an open end, and each lower portion having a feed point for receiving feed signals in phase quadrature. Disposed within each gap and electrically connected to each upper and lower portion is a corresponding parallel LC circuit configured to have a first impedance at a first frequency, and a second impedance greater than the first impedance, at a second frequency. Alternative embodiments include structures with ground planes and top-fed helices without ground planes.

35 Claims, 11 Drawing Sheets

L1 ELEVATION PATTERNS ACROSS BAND

L1 ELEVATION PATTERNS ACROSS BAND

FIG.3C L1 ELEVATION PATTERNS ACROSS BAND
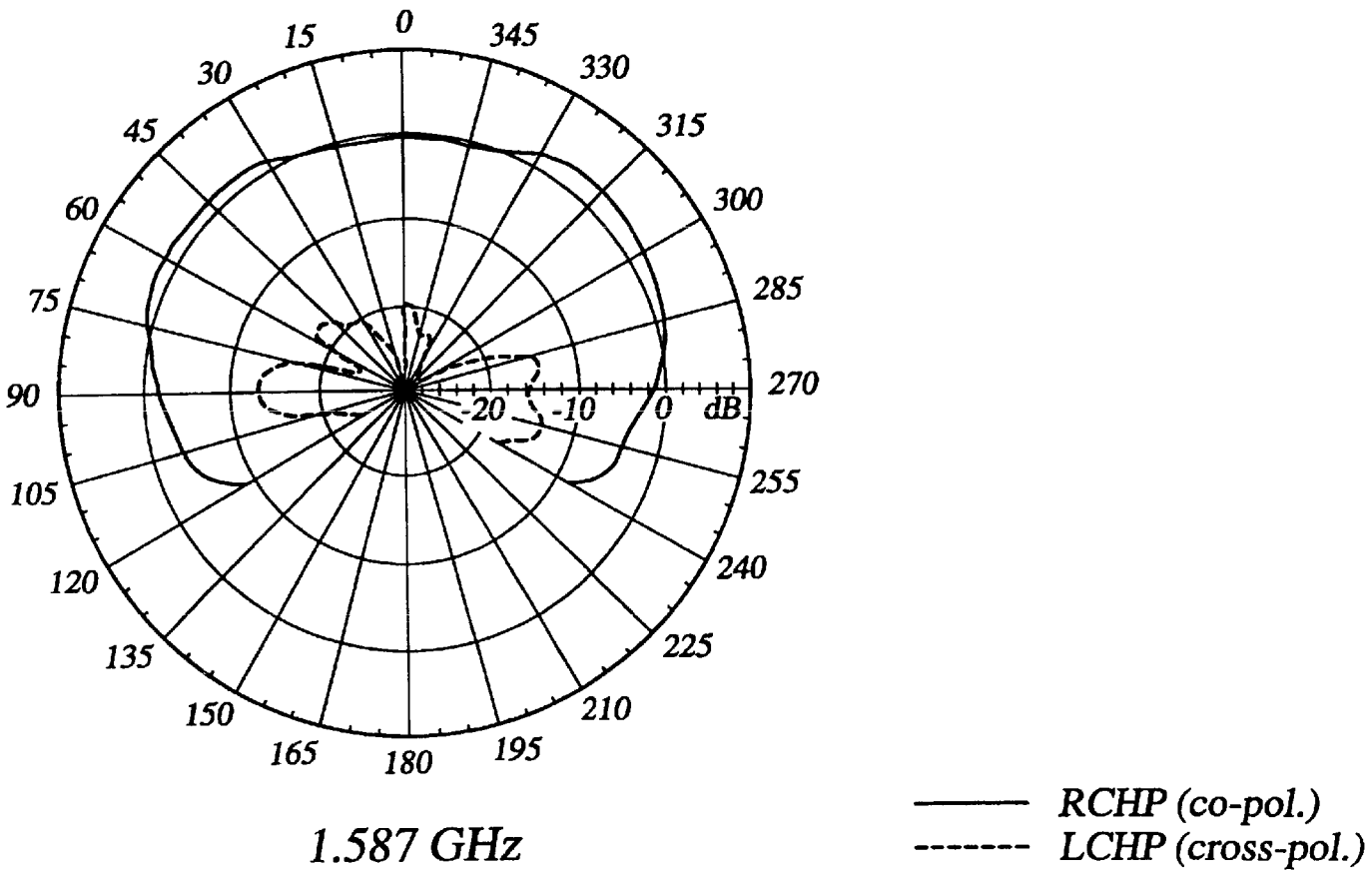

L2 ELEVATION PATTERNS ACROSS BAND

L2 ELEVATION PATTERNS ACROSS BAND

FIG.4C L2 ELEVATION PATTERNS ACROSS BAND
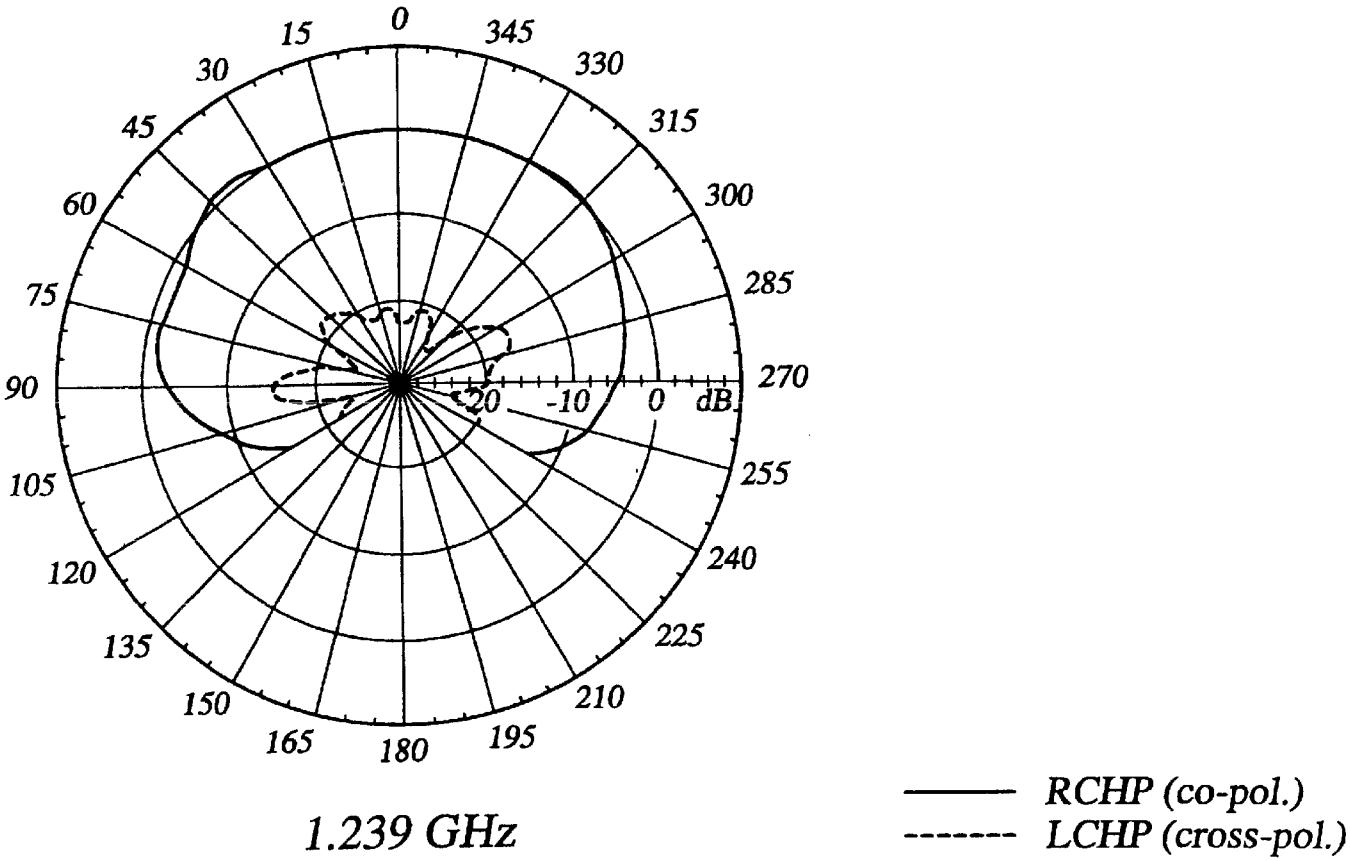

DUAL-BAND QUADRIFILAR HELIX ANTENNA

This application is related to commonly owned application Ser. No. 10/194,027 filed on Jul. 12, 2002 entitled "Single and Dual-Band Rotor/Helix Antenna Arrays", the contents of which are incorporated herein by reference as if reproduced in full below.

The U.S. Government has certain rights in this patent as provided for by the terms of contract No. 03016132 A8, NAVWAR FY01 awarded by the Department of Defense.

FIELD OF THE INVENTION

The present invention relates generally to antenna technology, and more particularly to a quadrifilar helix antenna assembly employing parallel LC resonant circuits to achieve dual band operation. This type of antenna can be applied, for example, in the context of satellite communications and navigation systems, such as have been undergoing development in the L band (for example INMARSAT, MSAT, PROSAT, NAVSTAR, GPS etc.) that can employ multiple frequencies. The relatively small size of the inventive antenna makes the antenna suitable for hand-held applications.

BACKGROUND OF THE INVENTION

Many contemporary communications and navigation products have been developed that rely on earth-orbiting satellites to provide necessary communications and navigation signals. Examples of such products include satellite navigation systems, satellite tracking and locator systems (e.g., GPS), and communications systems (e.g., NAVSTAR) that rely on satellites to relay the communications signals from one station to another. Most of the antennas used in these products have been physically much too large to satisfy the requirements of emerging satellite phone applications. In order for these products to be operationally useful in hand-held equipment, the antennas they employ should be small (comparable or smaller in size than the receiver itself).

Several types of antennas are now used for hand-held receivers of satellite signals, such as GPS receivers. All are relatively compact and can receive right hand circularly polarized signals from any direction above the ground (e.g., hemispherical coverage, although gain along the ground or horizon can be low). The requirement for compact size has several performance benefits in addition to its obvious portability. It enables the pattern to have slowly varying gain and low frequency dispersion over most of the field of view. The latter is important to provide the desired location accuracy.

Quadrifilar helix antennas have become widely used for communication and navigation receivers that operate at UHF, L and S Band frequencies. A commonly used antenna on hand-held GPS receivers, both commercial and military, is a resonant quadrifilar helix with limited bandwidth. This is a four-arm helix that is less than one wavelength of the transmitted and received signals in length and therefore has a narrower bandwidth in comparison with a longer helix. The advantages of this type of antenna include its relatively compact size and its cardioid shaped pattern with excellent circular polarization coverage and low axial ratio over most of the field of view. Since it is a resonant antenna, its dimensions are chosen to provide optimal performance for one frequency band. C. C. Kilgus first described this type of antenna in "Resonant Quadrifilar Helix", *IEEE Trans. Antennas and Propagation*, Vol. AP-17, May 1969, pp 349–351.

Most of the patents and literature relating to GPS antennas are directed toward quadrifilar helix antennas' use in civilian systems operating within one frequency band, L1. For the next generation of satellite-based communications and navigational equipment being developed, it will be necessary to simultaneously receive and/or transmit circularly polarized signals in multiple frequency bands (e.g., L1 and L2). Redundant reception of L1 and L2 signals will enhance reliability and be used to overcome ionospheric distortion. A description of several efforts in extending the bandwidth of quadrifilar helix antennas, particularly with the objective of accommodating separate frequency bands, can be found in a paper by J. M. Tranquilla and S. R. Best, "A Study of the Quadrifilar Helix for Global Positioning System Applications", *IEEE Trans. Antennas and Propagation*, Vol. AP-38, Oct. 1990, pp 1545–1550. Each of the techniques described therein has some limitations with respect to size and/or performance:

- Tapering the radius of a helix will increase its bandwidth. This is only appropriate, however, for longer helices that are not resonant (i.e., longer).
- A "piggyback" configuration of two helices, which are arranged coaxially with the low frequency helix below the high frequency helix, shows significant reduction of the gain and large phase variation for pattern of the low frequency helix at elevation angles below 45°.
- Placing a high frequency helix coaxially inside a lower frequency helix can result in dual-band operation, but it does so with a degradation of the performance of both helices in all directions of the upper hemisphere.
- The arms of two resonant quadrifilar helices can be interleaved. Because of the mutual coupling between the eight closely spaced arms, it is not practical to obtain low reflection loss and high radiation efficiency at two arbitrarily chosen frequencies. U.S. Pat. No. 5,828,348 to Tassoudji, et al., describes a low frequency band quadrifilar helix that is passively coupled to the high frequency helix. The input resistance of these antennas at the two resonance frequencies is low (10 to 15 ohms) and therefore requires transformers in each feed arm for impedance matching to the transmission lines of the feed network.

Thus, there remains a need for an antenna compact enough to be used in hand-held equipment, yet capable of operating in multiple satellite frequency bands. Such an antenna should also be capable of transmitting and/or receiving circularly polarized waveforms in different frequency bands, while providing a relatively high gain quasi-hemispherical radiation pattern over those bands.

SUMMARY OF THE INVENTION

The present invention provides a dual-band quadrifilar helix antenna capable of simultaneous operation in two frequency bands. In a preferred embodiment, the antenna is comprised of four radiating elements arranged helically to define a cylinder of constant radius, although other symmetric shapes are allowable. Each radiating element has an upper portion and a lower portion and a gap in between the upper and lower portions. Each upper portion of each radiating element has an electrically open end, and each lower portion of each radiating element has a feed point. The four feed points collectively receive 0°, 90°, 180° and 270° feed, or excite, signals (i.e., in phase quadrature) from a feed network. It is an advantage of the present invention that excitation of the antenna in both frequency bands may be effected through these common feed points.

A parallel LC (or "trap") circuit is disposed in the gap between, and electrically connects each upper and lower portion of each radiating element. The trap circuits each have a first impedance at a first frequency, and a second impedance greater than the first impedance, at a second frequency that is higher than the first frequency. This configuration enables dual frequency operation of the antenna at a lower first frequency being the resonant frequency corresponding to the entire length of each radiating element (including the trap), and at a second higher frequency being the resonant frequency corresponding to the length of the lower portion of each radiating element.

The radiating elements preferably have a left-hand twist over a single helical turn for receiving and/or transmitting right-hand circularly polarized signals. The signals intended to be received and/or transmitted have frequencies in the satellite frequency ranges, such as the L1 (1575 MHz) and L2 (1227 MHz) bands.

The antenna is preferably configured with a ground plane positioned beneath the four radiating elements. The ground plane operates to reflect the inherently backfire energy of the antenna.

In an alternative embodiment, the present invention provides a dual-band quadrifilar helix antenna which requires no ground plane. In this embodiment, the antenna is comprised of four radiating elements arranged helically with a right hand twist to define a cylinder of constant radius. Again, other symmetrical shapes are allowable. Each radiating element has an upper portion and a lower portion and a gap therebetween. Each lower portion of each radiating element has an electrically open end, and each upper portion has a feed point. The four feed points collectively receive feed signals in phase quadrature. Disposed within each gap between each upper portion and each lower portion of each radiating element lies a trap. Each trap is electrically connected to both the upper portion and the lower portion of one radiating element (or filar) at a position in that radiating element corresponding to the position at which the other traps are located in the other radiating elements. The trap circuit components are selected to provide the trap circuit with a first impedance at a first frequency, and a second impedance greater than the first impedance, at a second frequency that is higher than the first frequency. Because this embodiment requires excitation at the feed points at the "top" of the antenna, a means for providing the excitation signals to the feed points that traverses the length of the antenna is required. In some embodiments, this requirement is satisfied by a hollow conduit that extends coaxially throughout the length of the antenna, through which the excitation signals may be carried (e.g., on coaxial cables).

In preferred embodiments, the radiating elements are etched onto a radiator portion of a microstrip substrate. The feed network may also be etched onto the microstrip substrate. For transmit operations, the feed network accepts input signals and performs necessary power division and phase control or adjustment to provide the signal phases necessary to feed the radiating elements of the antenna. For receive operations, the feed network accepts and combines the signals received from the radiating elements.

BRIEF DESCRIPTION OF THE DRAWING

FIGS. 3A–3C are charts of elevation patterns across the L1 frequency band produced by a dual-band quadrifilar helix antenna created according to the present invention.

FIGS. 4A–4C are charts of elevation patterns across the L2 frequency band produced by a dual-band quadrifilar helix antenna created according to the present invention.

DETAILED DESCRIPTION OF CERTAIN PREFERRED EMBODIMENTS OF THE INVENTION

The present invention is directed toward a dual-band quadrifilar helix antenna operable in two distinct frequency bands. Certain embodiments of the invention will now be described with reference to the accompanying figures. It should be noted that the description of these embodiments in terms of a GPS receiver for receiving multiple frequencies is exemplary only, and in no way intended to be limiting. Artisans will readily understand that the rule of reciprocity allows the structures described below to be equally applicable to signal transmission as well as reception.

Antennas that are electrically small, have low ohmic loss and are passive, will have a relatively narrow bandwidth. Essentially they are "lossy" resonant circuits, with the loss representing radiation. By modifying the design of an antenna to be the equivalent of a double-tuned resonant circuit, the antenna can then be operated in two frequency bands. This is a technique that is used for a quadrifilar helix antenna in accordance with the present invention. Through this technique, reception and/or transmission in multiple frequency bands, such as L1 and L2, S, M and/or UHF bands is achievable by an antenna that is also compact enough to be useful in hand-held devices, such as a GPS receiver.

Figure 1A:
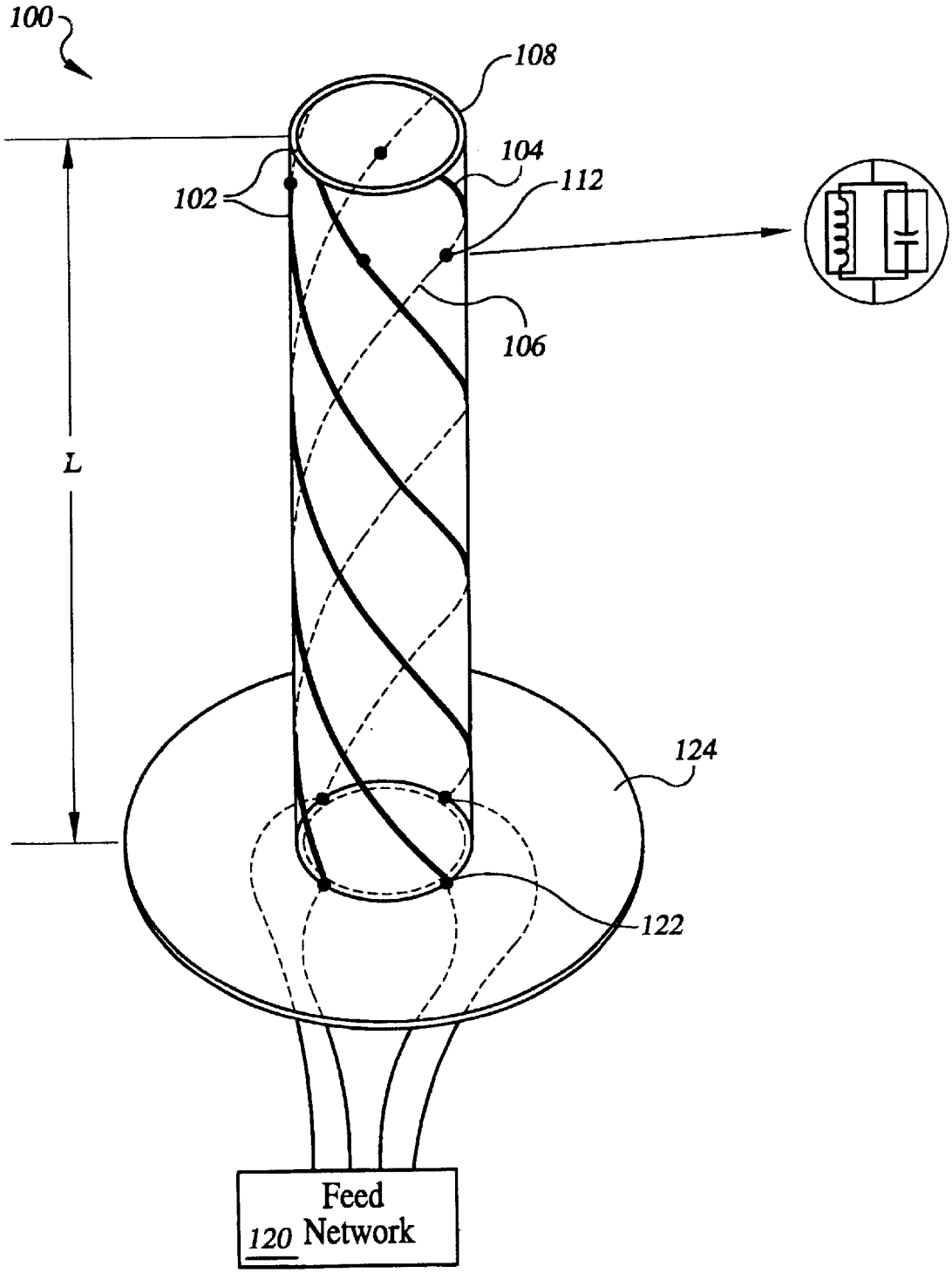
FIG. 1A is an illustration of a dual-band quadrifilar helix antenna in accordance with the present invention.

FIG. 1A illustrates a quadrifilar helix antenna 100 in accordance with one embodiment of the present invention. Each of the four radiating elements 102 of the antenna 100 is comprised of an electrically small conductor, such as a wire or flat ribbon, having an upper portion 104 and a lower portion 106 and a gap between the upper portion and the lower portion. Each of the radiating elements 102 are helically arranged such that they each traverse one helical turn, thereby defining a cylinder. The helical arrangement of the radiating elements 102 preferably has a left-hand twist in order to receive right hand circularly polarized signals and compensate for changes in the sense of polarization caused by reflections of circularly polarized electromagnetic signals from planar conductors.

According to certain preferred embodiments, the four radiating elements are etched onto a microstrip substrate. The microstrip substrate is rolled or formed into a symmetric, preferably cylindrical shape, so that the radiating elements are wound about a central axis. The diameter of such a cylinder defined is judiciously selected according to the desired impedance and bandwidth of the antenna. This cylindrical shape for the embodiments discussed below is not required to have a circular cross section. As long as the cross section represents an evenly distributed symmetrical shape, such as a rounded square, hexagon, octagon, and so forth, it is functional within the teachings of the present invention. Additionally, those skilled in the art will readily appreciate that some changes may be required to alter the radiation pattern of the antenna commensurate with the expected use of the antenna and operational requirements of a particular communication or navigation system. For example, for a discussion of pitch alteration effects, see C. C. Kilgus, "Shaped Conical Radiation Pattern Performance of the Backfire Quadrifilar Helix", *IEEE Trans. AP*, May 1975, p392–7, the contents of which are hereby incorporated by reference.

The overall length of each radiating element 102 (including the trap) is selected for resonant operation in a first frequency band, the first frequency band being the lower of the two frequency bands at which the antenna 100 is intended to operate. Resonant operation typically requires a length which is an odd integer multiple of the wavelength. In certain embodiments, the radiating elements 102 have sufficient rigidity such that they are self-supporting. In other embodiments, the radiating elements 102 may be supported by a cylindrical support structure 108. For example, in the experimental model described below, a Styrofoam cylinder provides structural support to the radiating elements. Foam typically has a dielectric constant of less than 1.1. Higher dielectric constant material will allow the antenna to be made smaller, but also will reduce bandwidth (and radiation resistance).

Each of the upper portions 104 of the radiating elements 102 is electrically open at one end and electrically connected to a trap circuit 112 at the other end. Each of the lower portions 106 is electrically connected to the trap circuit 112 at one end and is electrically connected to a feed network 120 through conductive feed points 122 located at the other end. An advantage of present invention is that both frequency bands may be fed through the common feed points 122. To provide resonant operation in the higher frequency band, the radiating elements 102 are designed such that the trap circuits 112 are positioned between each upper portion 104 and lower portion 106 at a point such that all of the upper portions 104 are of equal lengths and all of the lower portions 106 are of equal length. That is, the trap circuits 112 are equidistant from the respective open ends of the radiating elements 102 in which they are disposed. This position is selected to be the point at which the resulting length of the lower portions 104 of the radiating elements 102 corresponds to resonance at the second (higher) frequency.

The trap circuits 112 are passive circuits that operate as switches. They are each comprised of a parallel LC circuit (lumped components) that has infinite impedance (i.e., it forms an open circuit) at its resonant frequency. At the lower frequency, the trap circuits 112 have low reactive impedance that can be compensated by a slight change in the length of the upper portions 104 of the radiating elements 102. Thus, at the resonant frequency of the trap circuits 112, which coincides with the center frequency of the higher operational frequency band of the antenna, only the lower portions 106 effectively radiate energy.

Figure 6:
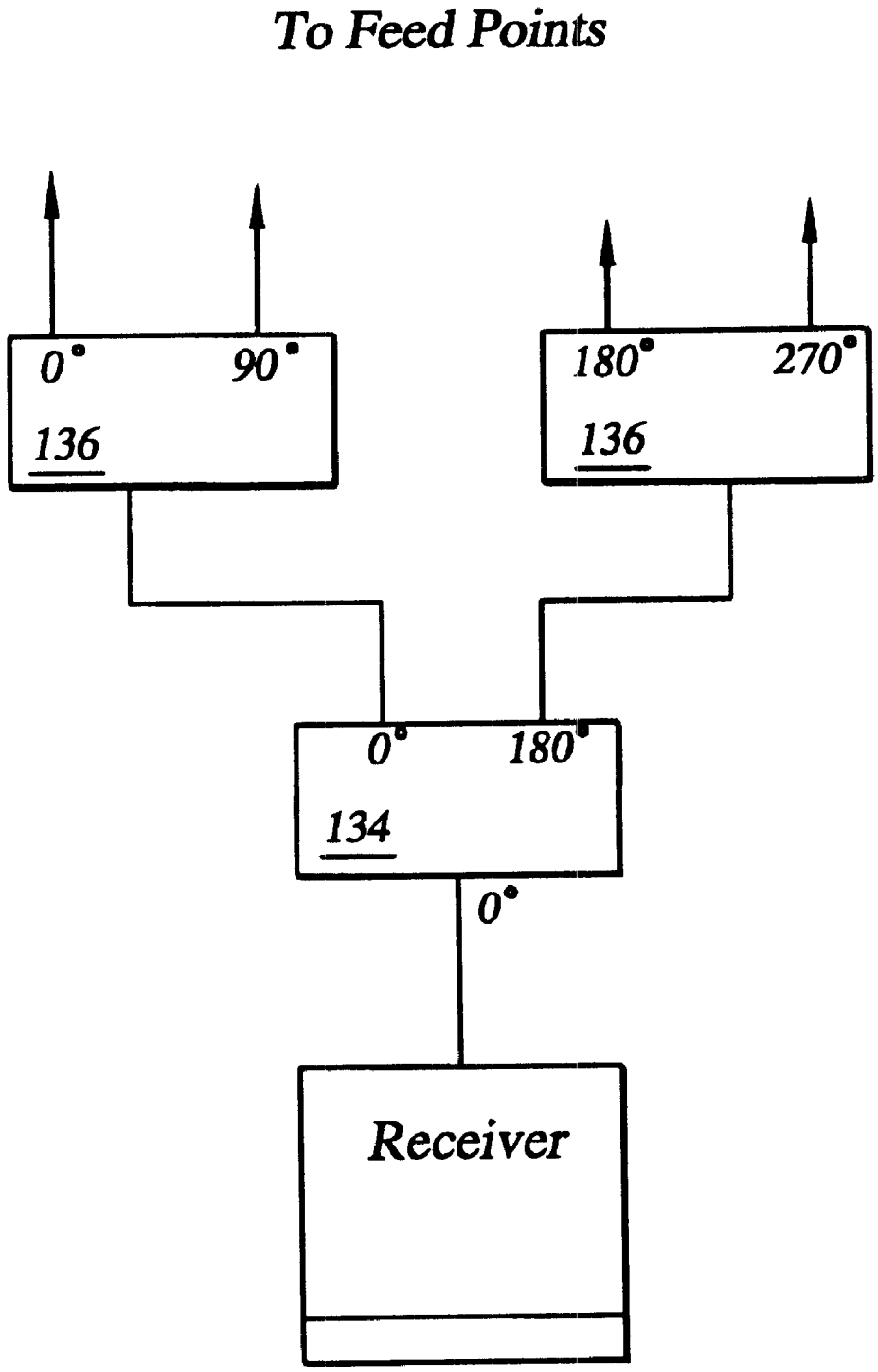
FIG. 6 is an block diagram of one proposed feed network for supplying feed signals in phase quadrature to the radiating elements.

The dual-band antenna requires a feed network 120 to provide the 0°, 90°, 180° and 270° signals needed to drive radiating elements 102. In one such feed network, as illustrated in FIG. 6, the radiating elements 102 are excited through feed points 122 with feed signals in phase quadrature to obtain circular polarization. In this feed network, the output of a 180° hybrid 134 is fed into two 90° hybrids 136. These hybrids devices have proven useful in implementing the teachings of the invention. However, those skilled in the art will appreciate that other known signal transfer structures besides those illustrated herein can be used. The antenna simply requires production of four signals for the radiating elements 102 with substantially equal power and appropriate phase relationships. The choice of a specific feed network structure depends on design factors known by those skilled in the art, such as manufacturability, reliability, cost, and so forth.

The peak of the radiation pattern for this antenna can be designed for either a forward axial direction (toward the open ends of the upper portions 104) or a backfire axial direction. Directing the radiation pattern in the forward axial direction requires placement of a small ground plane 124 perpendicular to the axis of the cylinder defined by the radiating elements 102 and near the feed points 122. The ground plane may have any shape, but is preferably circular and has a diameter less than or equal to one third of the free space wavelength of the signals being received and/or transmitted., Quadrifilar helix antennas are inherently backfire antennas, therefore directing the radiation pattern in the backfire axial direction simply requires configuring the antenna 100 with no ground plane 124. The ground plane 124 is a reflector to redirect the energy.

Figure 1B:
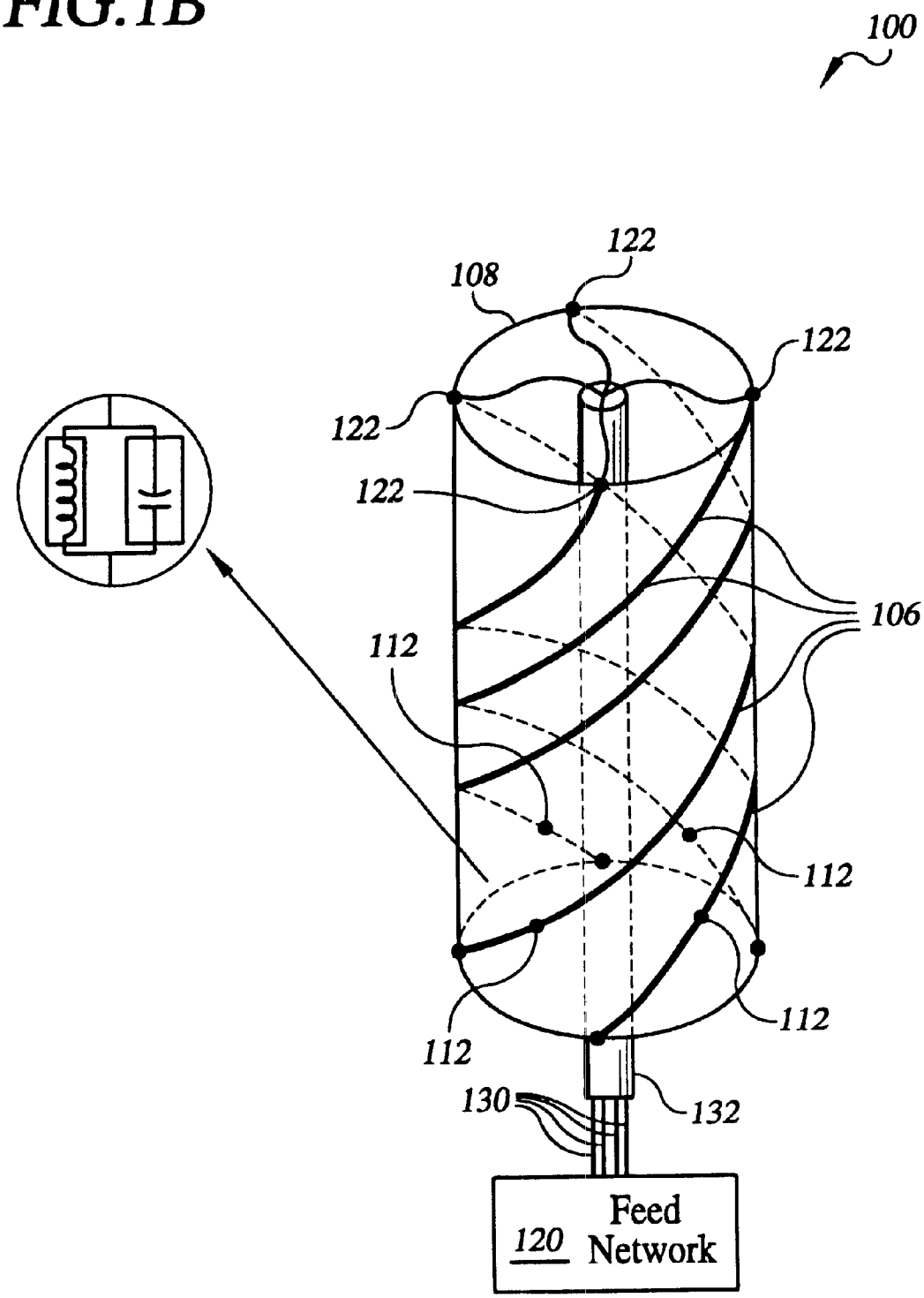
FIG. 1B is an illustration of an alternative embodiment of a dual-band quadrifilar helix antenna in accordance with the present invention.

As shown in FIG. 1B, in certain alternative embodiments the ground plane may be eliminated by feeding the radiating elements 102 at the feed points 122, which are, in these embodiments, located at the "top" of the antenna, and by changing the rotational twist of the radiating elements. The reference to "top" here means the end of the radiating elements closer to the desired hemispherical radiation pattern. In these embodiments, coaxial feed cables 130 are disposed within a tube 132 extending coaxially along the axis of the antenna with negligible impact on the performance. The electric field along this axis is zero. Experiments demonstrating negligible impact of a tube with an approximate diameter of 0.36" were conducted.

Working Model

Figure 2:
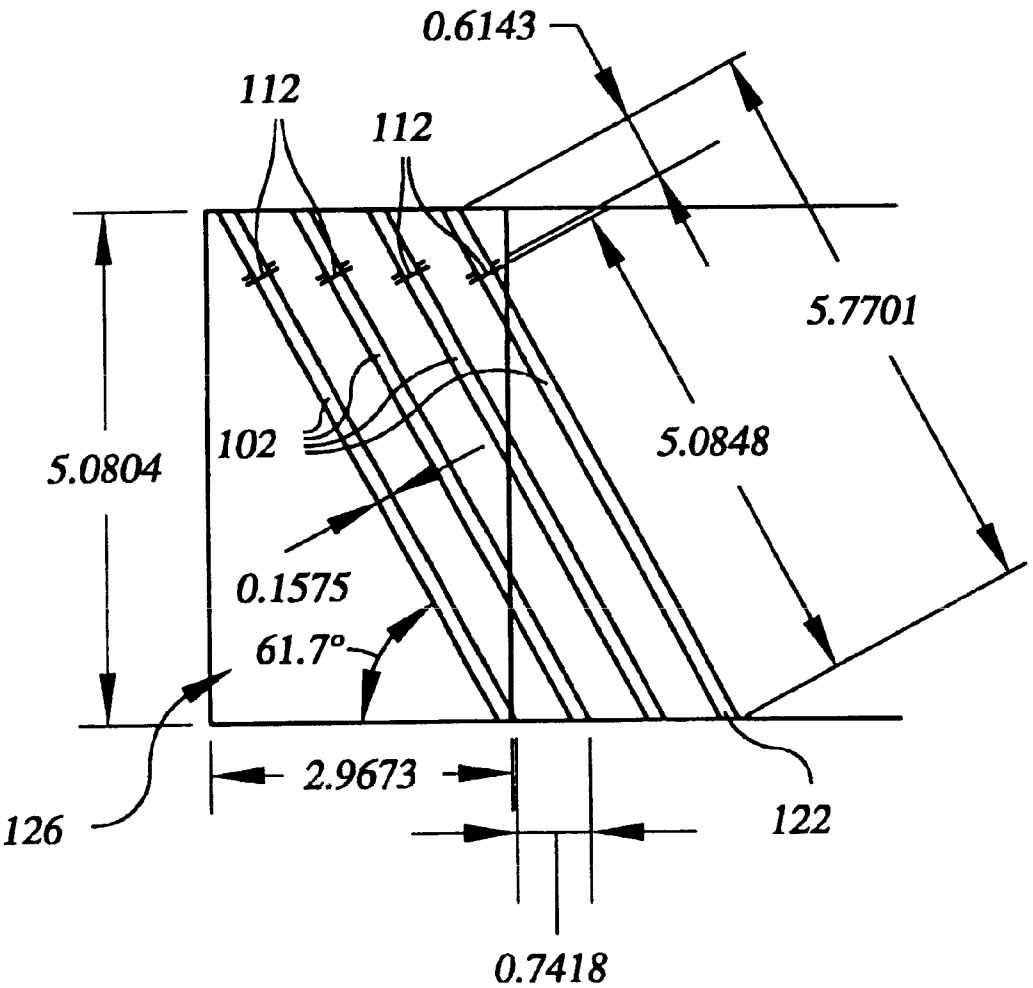
FIG. 2 is a dimensional illustration of four radiating elements used to create an experimental model of a dual band quadrifilar helix antenna.

A dual-band quadrifilar helix antenna was designed and constructed in accordance with the present invention. The antenna was designed to operate at two frequencies, 1227 MHz and 1575 MHz (the L2 and L1 GPS bands). FIG. 2 contains dimensions, in inches, related to the four radiating elements 102 of the antenna, which were formed from narrow copper strips. The strips were positioned upon a thin, flexible mylar sheet 126 that was then rolled into a cylinder approximately 1 inch in diameter. A styrofoam core was employed to maintain the cylindrical shape and provide support for the radiating elements.

The design procedure began by configuring an open-ended quadrifilar helix, the filars of which would become the lower portions of the dual-band antenna's radiating elements resonant at the higher operating frequency. The trap (parallel LC) circuits were then soldered to the ends of each lower portion (filar). The trap circuits' resonant frequency was chosen to be the center of the higher frequency band. Then the upper portions of the radiating elements were soldered to the trap circuits, extending the radiating elements to a length (including the trap circuits) corresponding to resonancy at the center frequency of the lower band. For this design, the resonant input impedance at the two specified frequencies was approximately 50 ohms. In the working model, the trap circuits components, an inductor and capacitor, were soldered across the gap in each radiating element that is approximately 0.6 inches from the open ends of the radiating elements 102. The trap circuit values of this model quadrifilar helix antenna were selected to be L=6.8 nh and C=1.5 pf in order to provide anti-resonance at the higher frequency. As stated earlier, the choice of L will affect the required length of the upper portions 104 of the radiating elements. Also, if the inductance has significant ohmic loss, it will induce the radiation efficiency at the lower frequency band. The four radiating elements 102 were then attached at their feed points 122 to the center conductors of four coaxial connectors through a ground plate 124 (as illustrated in FIG. 1) whose diameter of approximately 3 inches was selected to reflect most of the energy radiated from the antenna to the upper hemisphere while still maintaining coverage for angles just below the horizon (i.e., a cardioid pattern).

Figure 3A:
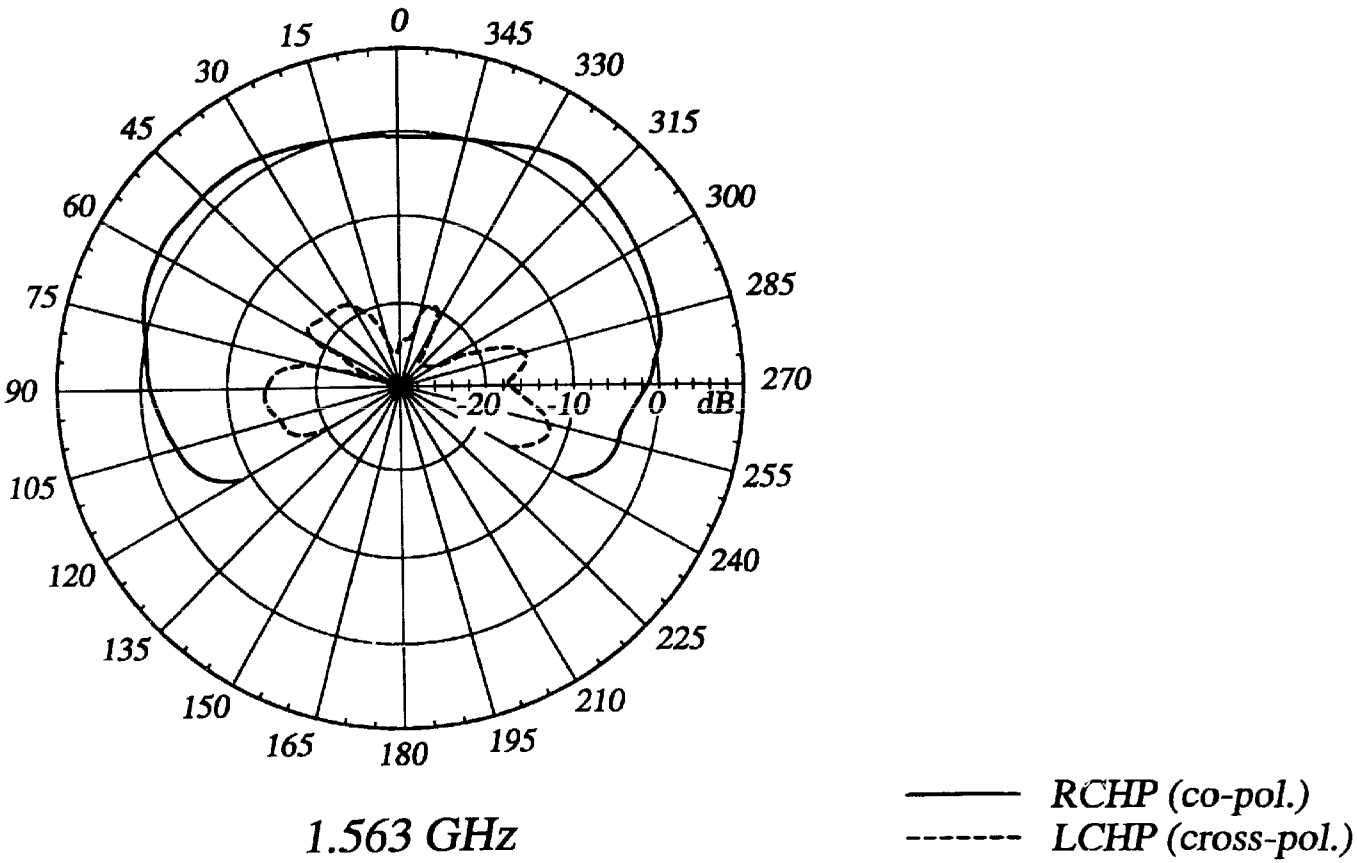
Figure 3B:
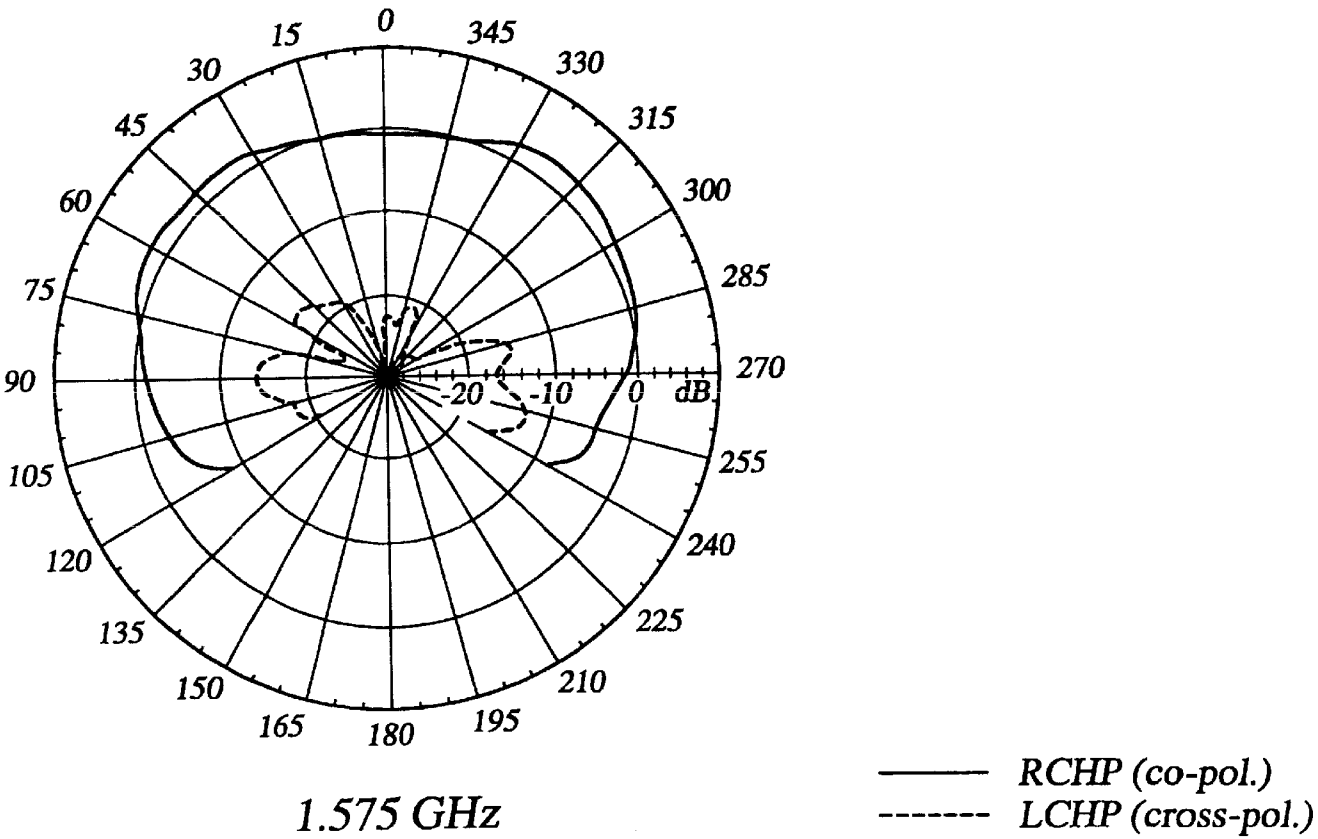
Figure 4A:
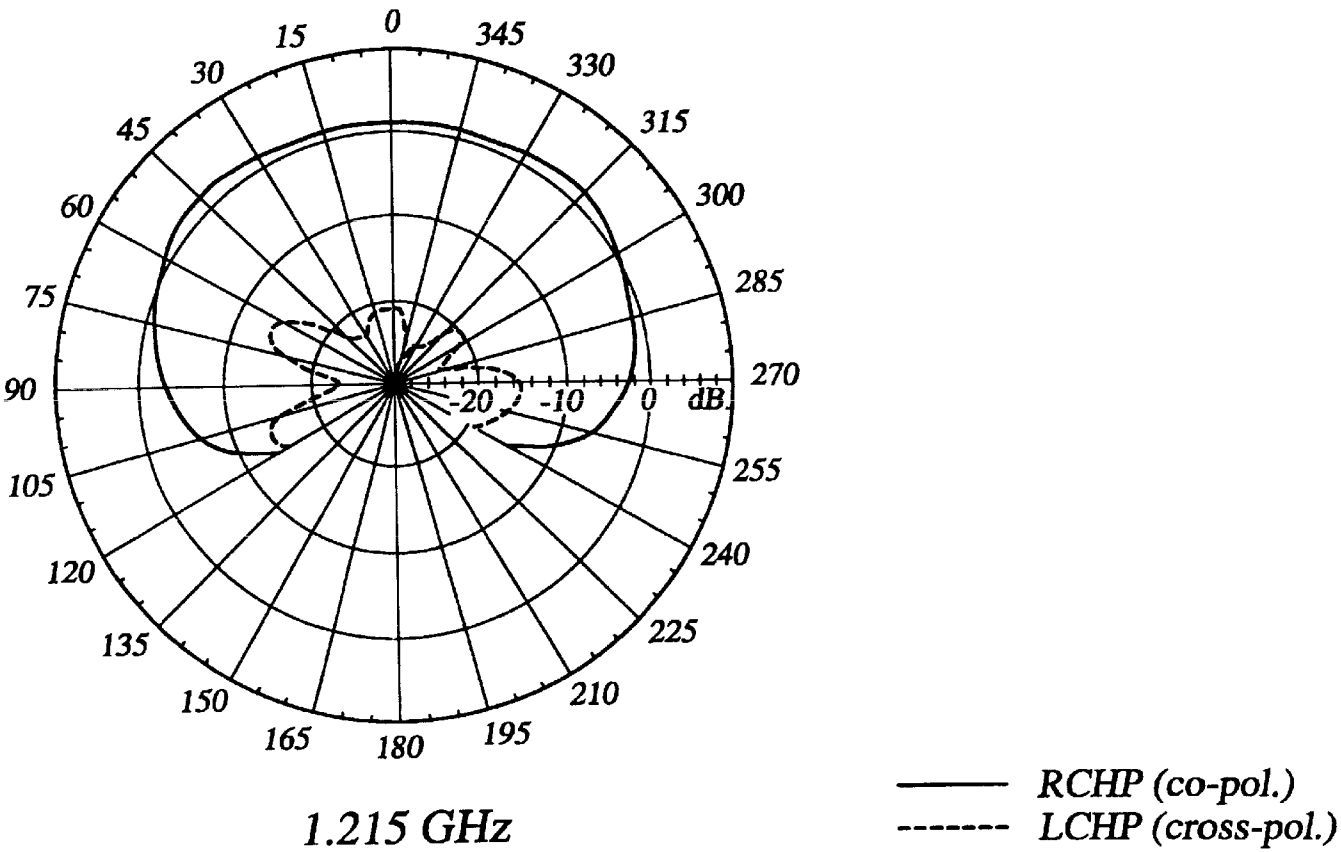
Figure 4B:
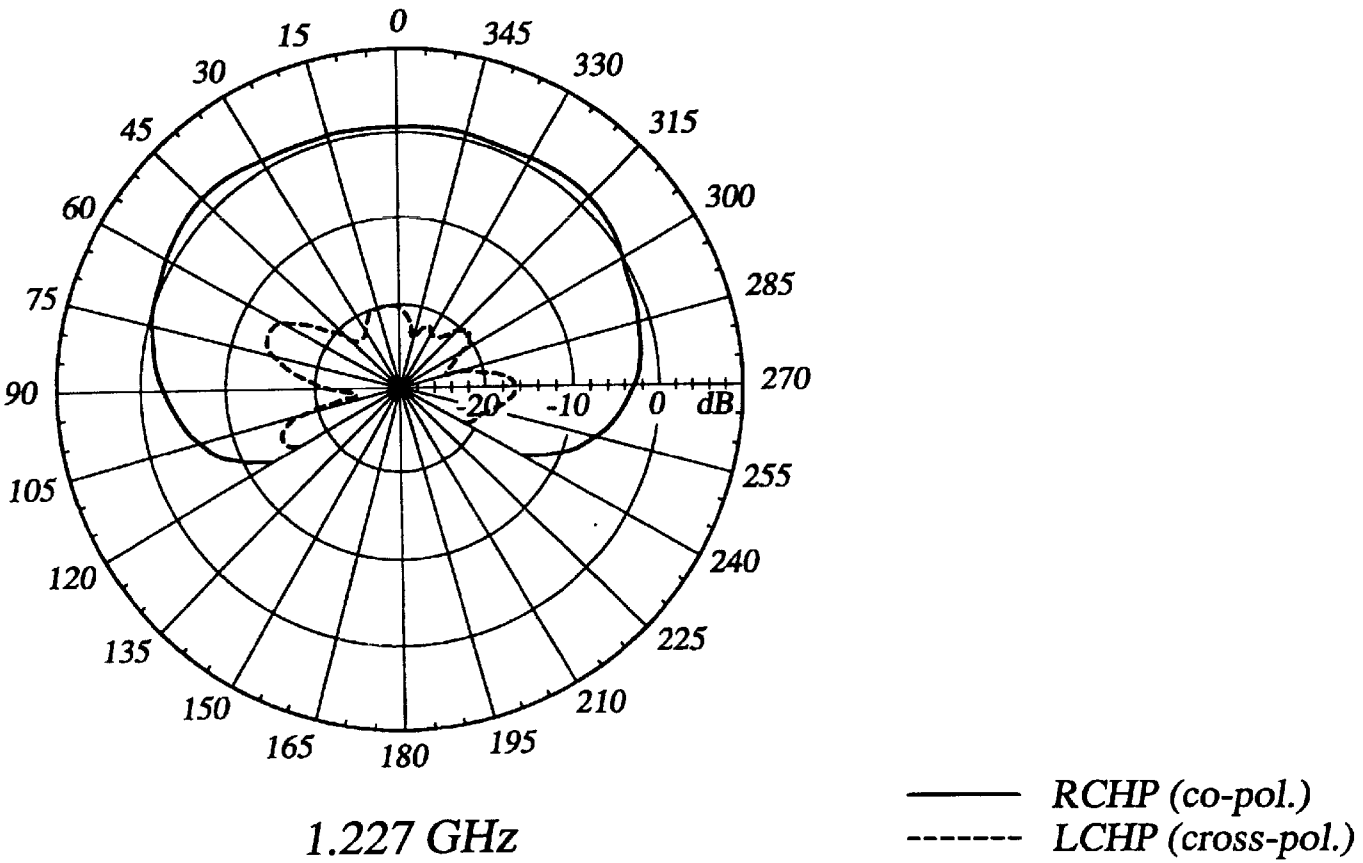

FIGS. 3A through 3C depict elevation plane patterns measured across the L1 frequency band. FIGS. 4A through 4C depict elevation plane patterns measured across the L2 frequency band. The solid-line curves represent the right hand circularly polarized patterns and the dashed-line curves represent the left hand circularly polarized patterns, respectively. Note that the antenna achieves small gain variation (<4 dB over the upper hemisphere and <2 dB to 80 degrees from the zenith). The antenna also has high axial ratio (low cross polarization) over the hemisphere, which can suppress multipath reflections.

Figure 5:
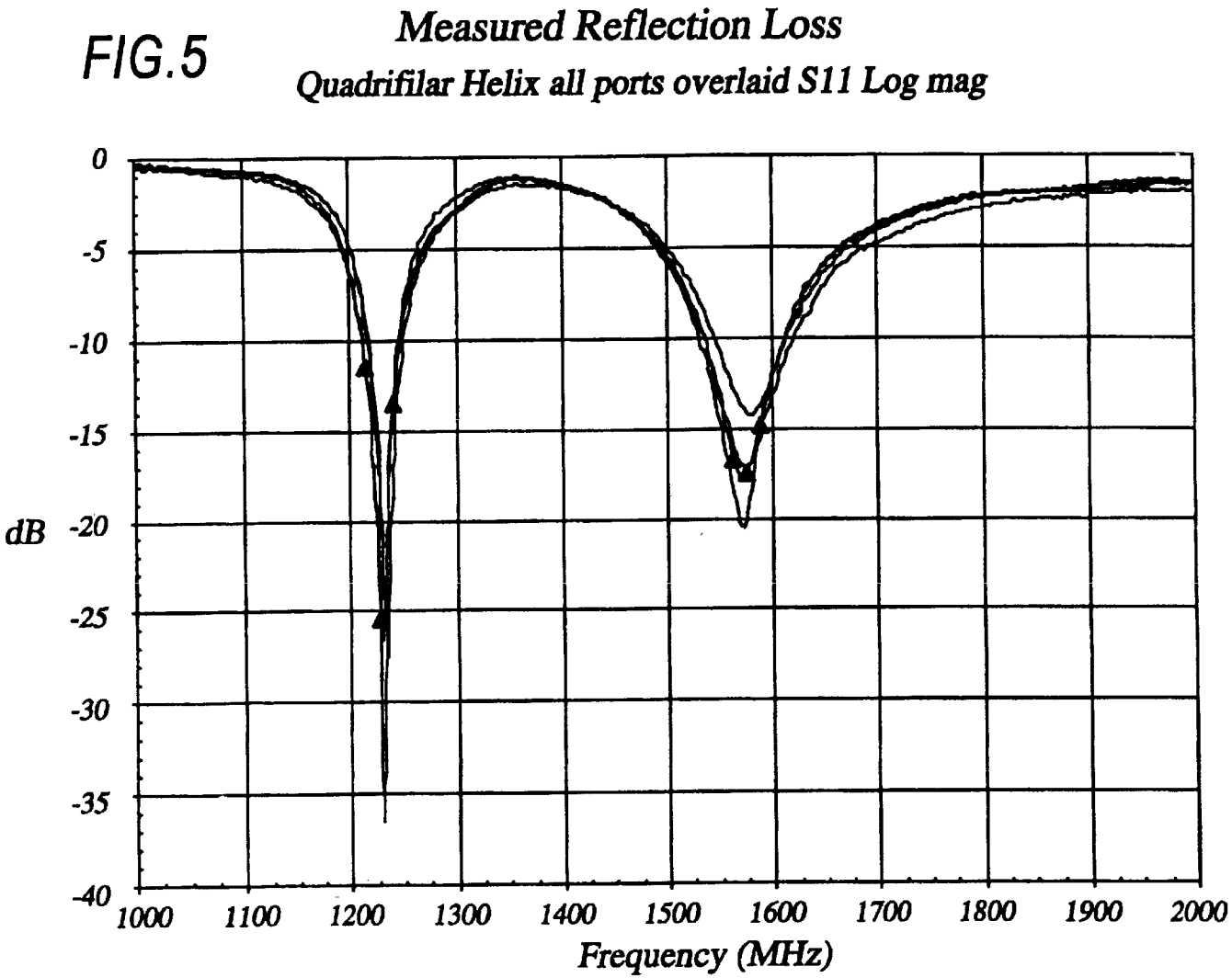
FIG. 5 is a plot of the measured reflection loss at the feed points of a dual-band quadrifilar helix antenna created according to the present invention.

The input match for the antenna is illustrated in FIG. 5 by an overlay of the reflection coeficients at the feed points 122 of each of the four radiating elements 102 of of the helix. The feed network for exciting the four radiating elements 102 was designed and created from commercial off the shelf components, a 180° hybrid and two 90° hybrids, that are compact and wideband. As previously stated, other phased quadrature excitation schemes are known in the art and could alternatively have been used.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims. For instance, in practical implementation, a compact protective radome may be used. The radome could be formed from a dense foam or a more rigid, but thin, composite material. The latter would require retuning the four radiating elements of the helix (modifying their length) to compensate for the effect of the dielectric material in the radome. In other embodiments also within the scope of the present invention, the trap circuits could be created from printed circuit components (L and C) rather than the discrete components that were used in the working model described above.

What is claimed is:

1. A dual-band quadrifilar helix antenna, comprising four helical radiating elements each having an upper portion and a lower portion and a gap therebetween, each upper portion having an open end, and each lower portion having a feed point for receiving feed signals in phase quadrature;

four traps, one corresponding trap each disposed in the gap and electrically connected to the upper portion and lower portion of a corresponding one of the four radiating elements equidistant from the corresponding open end, the traps configured to have a first impedance at a first frequency, and a second impedance greater than the first impedance, at a second frequency; and at least one feed network providing 0°, 90°, 180° and 270° signals to the feed points.

2. The dual-band quadrifilar antenna of claim 1, wherein the four radiating elements are further comprised of strips of electrically conductive material printed on a dielectric microstrip substrate.

3. The dual-band quadrifilar antenna of claim 1, wherein the four radiating elements are of equal length.

4. The dual-band quadrifilar antenna of claim 3, wherein the length of the radiating elements is less than or equal to the wavelength in free space of the signals being fed to the feed points.

5. The dual-band quadrifilar antenna of claim 1, wherein the radiating elements receive multiple circularly polarized signals.

6. The dual-band quadrifilar antenna of claim 1, wherein the radiating elements transmit multiple circularly polarized signals.

7. The dual-band quadrifilar antenna of claim 1, wherein the radiating elements have a left twist for reception of right hand circularly polarized radiation.

8. The dual-band quadrifilar antenna of claim 1, wherein the radiating elements have a right twist for reception of left hand circularly polarized radiation.

9. The dual-band quadrifilar antenna of claim 1, wherein each radiating element completes one helical turn.

10. The dual-band quadrifilar antenna of claim 1, wherein the first frequency is in a satellite frequency range.

11. The dual-band quadrifilar antenna of claim 10, wherein the first frequency band is the L1 band.

12. The dual-band quadrifilar antenna of claim 1, wherein the second frequency is in a satellite frequency range.

13. The dual-band quadrifilar antenna of claim 12, wherein the second frequency is the L2 band.

14. The dual-band quadrifilar antenna of claim 1, wherein the traps are comprised of printed circuit components.

15. The dual-band quadrifilar antenna of claim 1, further comprising a ground plane coaxially positioned near the feed points through which the feed network provides the signals to the feed points.

16. The dual-band quadrifilar antenna of claim 15, wherein the ground plane is substantially circular and has a diameter less than or equal to one third of the wavelength in free space of the signals being provided.

17. The dual-band quadrifilar antenna of claim 1, wherein the feed network further comprises:

a 180° hybrid for providing from an input signal first and second output signals that differ from each other by 180°;

a first 90° hybrid having an input arm for accepting said first output signal from said 180° hybrid and further having a first output arm for providing a third output signal and a second output arm for providing a fourth output signal, wherein said third and fourth output signals differ from one another by 90°; and a second 90° hybrid having an input arm for accepting said second output signal from said 180° hybrid and further having a third output arm for providing a fifth output signal and a fourth output arm for providing a sixth output signal, wherein said fifth and sixth output signals differ from one another by 90°.

18. The dual-band quadrifilar antenna of claim 1, further comprising a protective radome covering the radiating elements.

19. The dual-band quadrifilar antenna of claim 1, further comprising means for supporting the helical structure of the radiating elements.

20. A dual-band quadrifilar helix antenna, comprising four radiating elements arranged helically to define a cylinder of constant radius, each radiating element having an upper portion and a lower portion and a gap therebetween, each lower portion having an open end, and each upper portion having a feed point for receiving feed signals in phase quadrature;

four traps, one corresponding trap each disposed in the gap and electrically connected to the upper portion and lower portion of a corresponding one of the four radiating elements equidistant from the corresponding open end, the traps configured to have a first impedance at a first frequency, and a second impedance greater than the first impedance, at a second frequency;

conduit means disposed along the axis of the cylinder through which the feed signals are fed; and a feed network providing 0°, 90°, 180° and 270° feed signals to the feed points.

21. The dual-band quadrifilar antenna of claim 20, wherein the four radiating elements are further comprised of strips of electrically conductive material printed on a dielectric support.

22. The dual-band quadrifilar antenna of claim 20, wherein the four radiating elements are of equal length.

23. The dual-band quadrifilar antenna of claim 22, wherein the length of the radiating elements is less than or equal to the wavelength in free space of the signals being fed to the feed points.

24. The dual-band quadrifilar antenna of claim 20, wherein the radiating elements receive multiple circularly polarized signals.

25. The dual-band quadrifilar antenna of claim 20, wherein the radiating elements transmit multiple circularly polarized signals.

26. The dual-band quadrifilar antenna of claim 20, wherein the radiating elements have a right twist for reception of right hand circularly polarized radiation.

27. The dual-band quadrifilar antenna of claim 20, wherein each radiating element completes one helical turn.

28. The dual-band quadrifilar antenna of claim 20, wherein the first frequency is in a satellite frequency range.

29. The dual-band quadrifilar antenna of claim 20, wherein the first frequency band is the L1 band.

30. The dual-band quadrifilar antenna of claim 20, wherein the second frequency is in a satellite frequency range.

31. The dual-band quadrifilar antenna of claim 20, wherein the second frequency is the L2 band.

32. The dual-band quadrifilar antenna of claim 20, wherein the traps are comprised of printed circuit components.

33. The dual-band quadrifilar antenna of claim 20, further comprising:

a 180° hybrid for providing from an input signal first and second output signals that differ from each other by 180°;

a first 90° hybrid having an input arm for accepting said first output signal from said 180° hybrid and further having a first output arm for providing a third output signal and a second output arm for providing a fourth output signal, wherein said third and fourth output signals differ from one another by 90°; and a second 90° hybrid having an input arm for accepting said second output signal from said 180° hybrid and further having a third output arm for providing a fifth output signal and a fourth output arm for providing a sixth output signal, wherein said fifth and sixth output signals differ from one another by 90°.

34. The dual-band quadrifilar antenna of claim 20, further comprising a protective radome covering the radiating elements.

35. The dual-band quadrifilar antenna of claim 20, further comprising means for supporting the helical structure of the radiating elements.

* * * * *